US005084094A

United States Patent [19]

Francois et al.

[11] Patent Number: 5,084,094

[45] Date of Patent: Jan. 28, 1992

[54] METHOD AND APPARATUS FOR CLEANING A LIQUID METAL BATH FOR HOT DIPPING OF A STEEL STRIP

[75] Inventors: Bernard Francois, Nogent Sur Oise; Robert Haaser, Quatzenheim; Pierre Commun, Creil; Jean-Paul Hennechart, Mouzon, all of France

[73] Assignee: Sollac, Puteaux, France

[21] Appl. No.: 617,033

[22] Filed: Nov. 21, 1990

[30] Foreign Application Priority Data

Nov. 21, 1989 [FR] France ..... 89 15267

[51] Int. Cl.[5] ..... C22B 1/00

[52] U.S. Cl. ..... 75/663; 75/697; 266/227

[58] Field of Search ..... 75/663, 697; 266/227

[56] References Cited

U.S. PATENT DOCUMENTS 2,734,819 2/1956 Williams ..... 75/663

OTHER PUBLICATIONS

Patent Abstracts of Japan, vol. 13, No. 408 Jpn. -A-01 147 047 (Sumitomo Metal Ind. Ltd.) 08-06-1989.

Patent Abstracts of Japan, vol. 13, No. 408 Jpn. -A-01 147 046 (Sumitomo Metal Ind. Ltd.) 08-06-1989.

Patent Abstracts of Japan, vol. 12, No. 270 Jpn. -A- 63 50 454 (Nippon Steel Corp.).

Journal of Metals, JOM, vol. 34, No. 7, Jul. 1982, pp. 7-8, Warrendale, Pa., U.S.; "NKK develops galvanizing bath to remove dross".

Patent Abstracts of Japan, vol. 12, No. 37 Jpn. -A-62 185 863 (Nippon Steel Corp.).

Patent Abstracts of Japan, vol. 13, No. 39 Jpn. -A-63 238 252 (Sumitomo Metal Ind. Ltd.).

*Primary Examiner*—Peter D. Rosenberg

*Attorney, Agent, or Firm*—Cushman, Darby & Cushman

[57] ABSTRACT

The present invention relates to a method for cleaning a liquid metal bath, in particular a zinc or zinc-aluminum bath intended for the continuous production of a steel strip coated by immersion in a coating zone (5*a*), according to which method the metal coating bath (2) is cycled continuously between the coating zone (5*a*) and a cleaning zone (5*b*), the rise of solid intermetallic compounds contained in the said bath to the surface is brought about in the cleaning zone (5*b*), the rise of the said compounds in accelerated and the cleaned bath (2), the iron content of which is close to or below the solubility limit, is led back to the zone (5*a*).

The invention also relates to an apparatus for carrying out the method.

10 Claims, 4 Drawing Sheets

Figure 1:
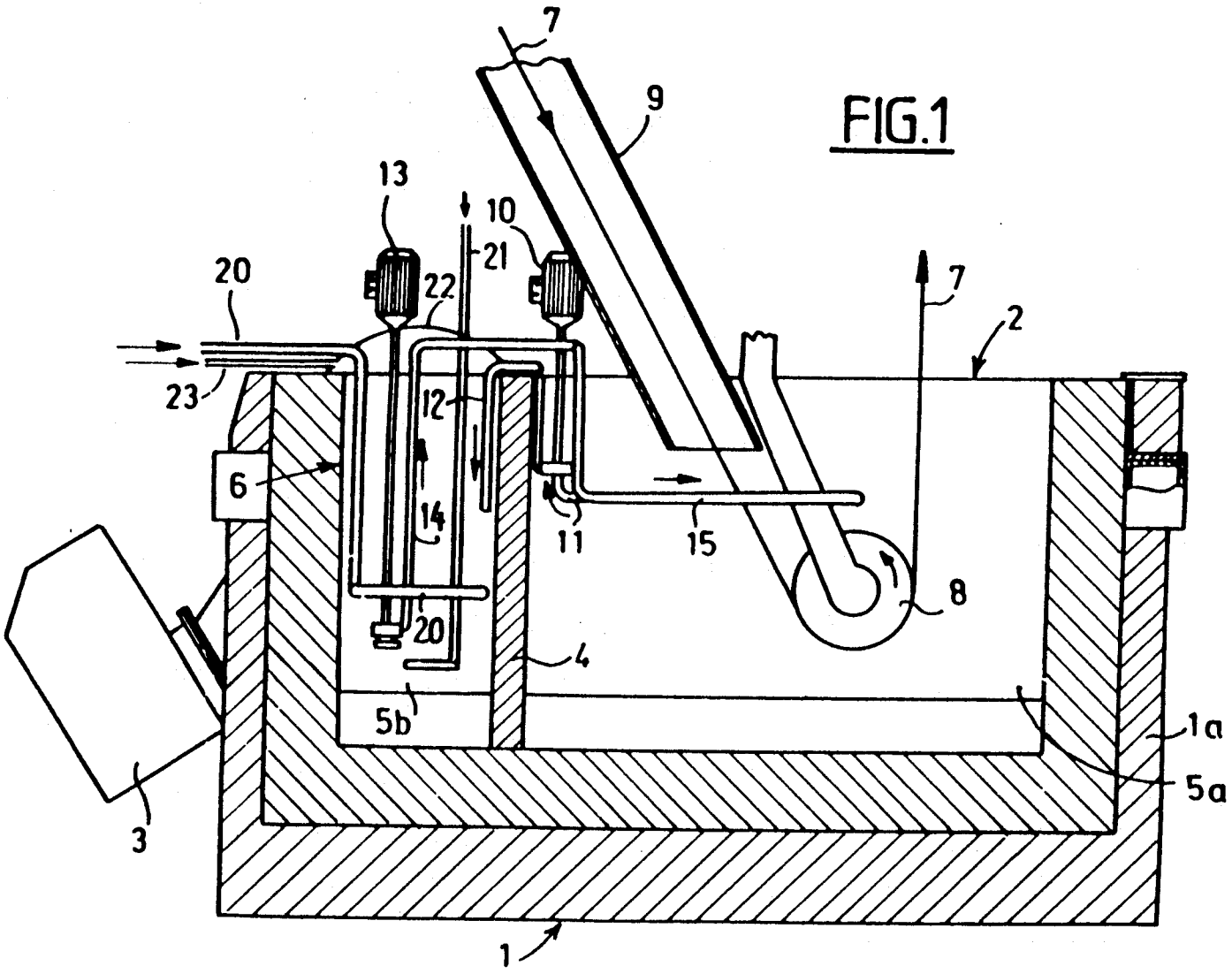

METHOD AND APPARATUS FOR CLEANING A LIQUID METAL BATH FOR HOT DIPPING OF A STEEL STRIP

The present invention relates to a method and an apparatus for cleaning a liquid metal bath, in particular a zinc or zinc-aluminum bath, intended for the continuous production of a steel strip coated by immersion.

The present invention is particularly suitable for continuous hot galvanizing.

During the immersion of the steel strip in the liquid metal bath, the iron of said strip is attacked by the liquid metal bath and dissolves into the said bath. Above the solubility limit, the iron reacts with the elements of the bath to form solid intermetallic compounds in the form of zinc-iron, zinc-iron-aluminum or zinc-aluminum particles in the case of hot dip galvanizing.

These particles have a size ranging from a few microns to a few hundred microns depending on the degree of saturation of the bath. Depending on their density and their composition, these particles rise to the surface or remain in saturated solution or settle on the bottom of the bath. Consequently, the particles can be entrained by the strip and remain included in the coating. However, the inclusions of particles are prejudicial to the surface appearance and to the use of the hot-galvanized sheet metal, in particular for the visible parts of automobile bodywork.

The aim of the present invention is to restrict the size and the amount of particles present in the bath, particularly in the proximity of the strip, and consequently to restrict their presence in the coating.

The present invention thus relates to a method for cleaning a liquid metal bath, in particular a zinc or zinc-aluminum bath, intended for the continuous production of a steel strip coated by immersion in a coating zone, consisting in:

continuous cycling of the metal coating bath between the coating zone and a cleaning zone, bringing about, in the cleaning zone, the rise to the surface of solid intermetallic compounds contained in the said bath, accelerating the rise of the said solid intermetallic compounds, and leading the cleaned bath, the iron content of which is close to or below the solubility limit, back to the coating zone, characterized in that the rise of the solid intermetallic compounds in the cleaning zone is brought about by a lowering in the temperature of the bath in the said cleaning zone in order to lower the solubility limit of iron.

According to other characteristics:

the temperature of the bath in the cleaning zone is between 435° and 460° C. and preferably between 440° and 450° C., the temperature of the bath in the coating zone being between 440° and 490° C. and preferably between 460° and 470° C., the said rise of the solid intermetallic compounds in the cleaning zone is accelerated by a higher aluminum concentration of the bath in the cleaning zone, and the aluminum concentration of the bath in the cleaning zone is between 0.15 and 0.70% and preferably between 0.20 and 0.30%.

The invention also relates to an apparatus for cleaning a liquid metal bath, in particular a zinc or zinc-aluminum bath, intended for the continuous production of a steel strip coated by immersion in a tank forming a coating zone, comprising means for continuous cycling of the liquid metal bath between the coating zone and a chamber forming a cleaning zone and vice versa, means effecting the rise to the surface, in the cleaning zone, of the solid intermetallic compounds contained in the said bath, and means for accelerating the rise of the said solid intermetallic compounds, characterized in that the means for continuous cycling of the liquid metal bath comprise at least one variable speed pump and in that the said variable speed pump withdraws the polluted liquid metal bath from the coating zone via piping and transmits it to the two ends of the cleaning zone at a level which is between half and two thirds the height of the bath in the said zone.

According to other characteristics:

the said variable speed pump takes up the cleaned liquid metal bath from the lower part of the cleaning zone and transmits it through piping into the coating zone, the means effecting the rise to the surface, in the cleaning zone, of the solid intermetallic compounds consist of a bath cooling cycle in the said zone so as to keep the temperature of the said bath below the temperature of the bath in the coating zone, and the means for accelerating the rise to the surface, in the cleaning zone, of the solid intermetallic compounds consist of ingots which are introduced into the said cleaning zone and the average aluminum content of which is between 0.30 and 0.80% and preferably between 0.40 and 0.50%.

Figure 2:
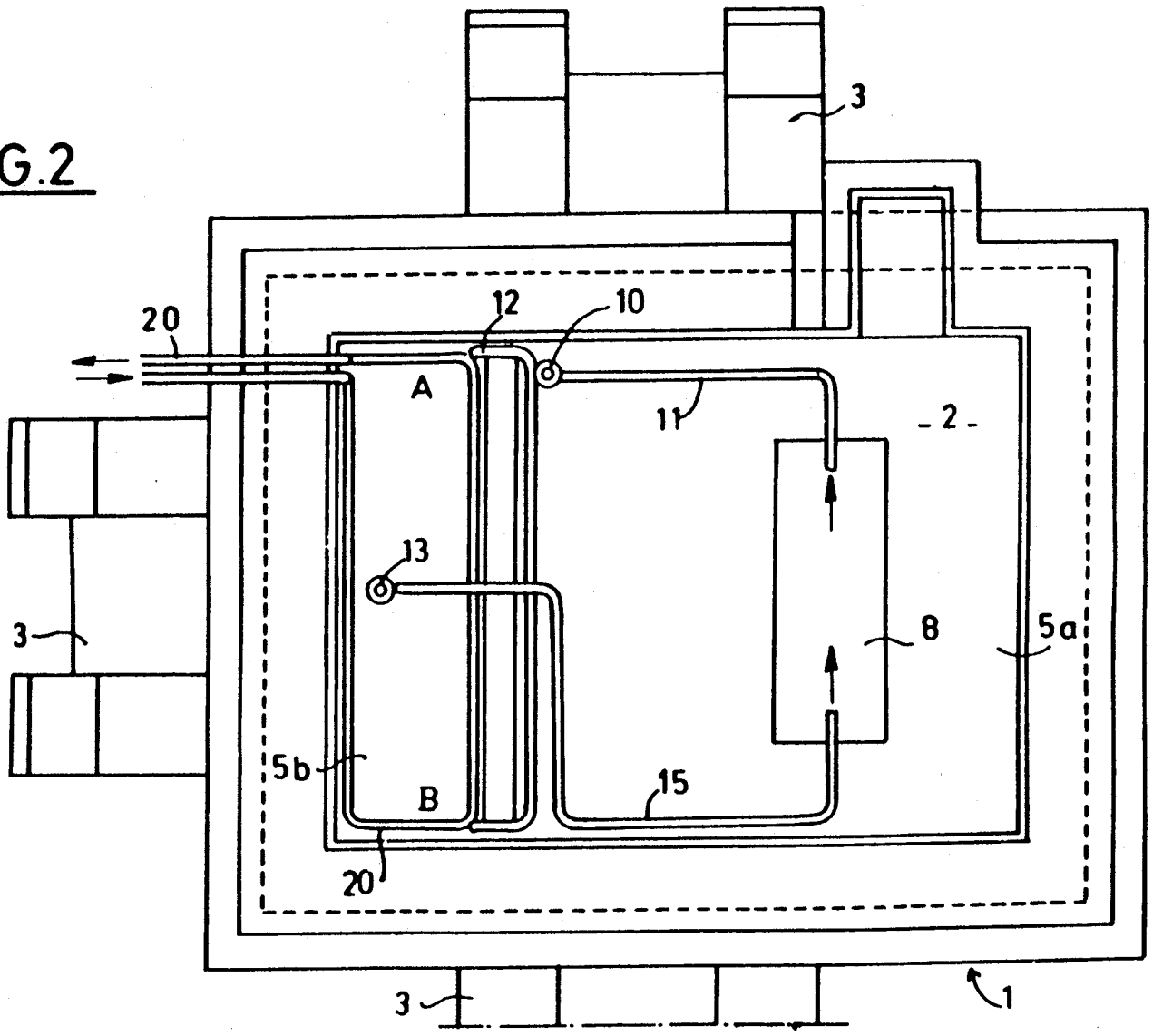
Figure 3:
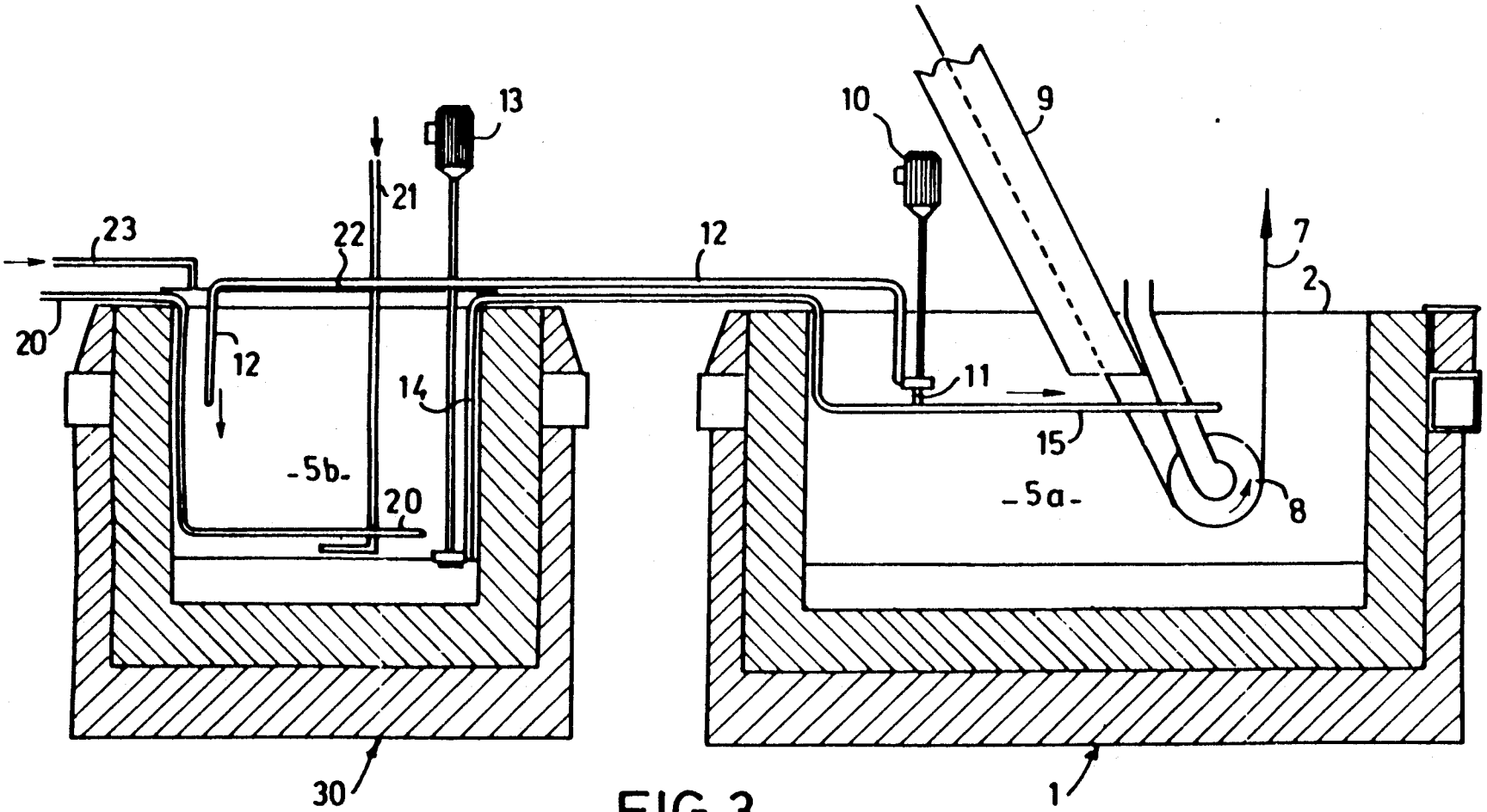
Figure 4:
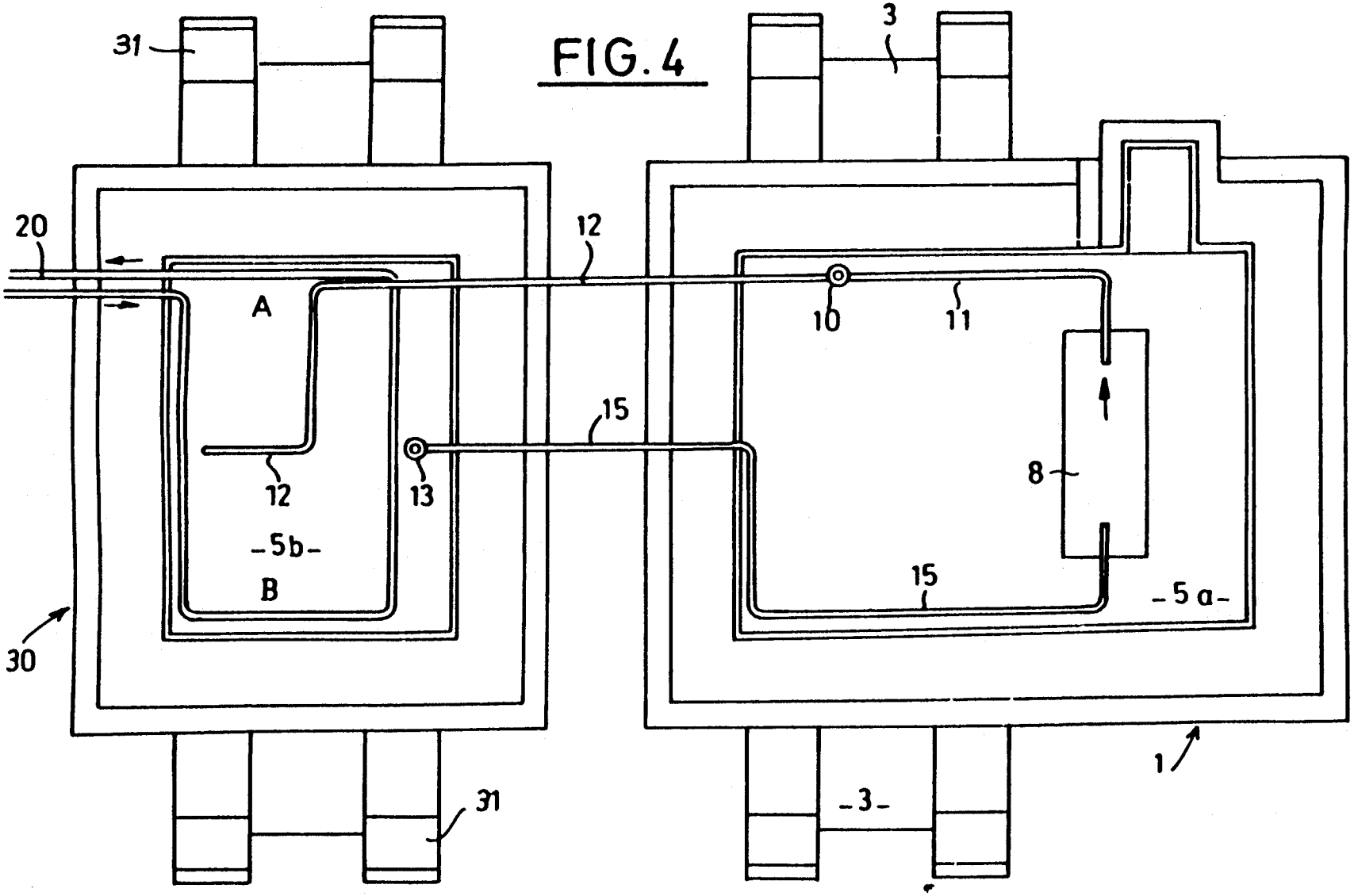

The invention will be better understood with the aid of the description which follows, which is given solely by way of example, with reference to the appended drawings, on which:

FIG. 1 is a cross-sectional diagrammatic view of a fresh or replenished coating tank provided with the apparatus according to the invention, FIG. 2 is view of FIG. 1 from above, FIG. 3 is a cross-sectional diagrammatic view of an existing coating tank with which the apparatus according to the invention is combined, and FIG. 4 is a view of FIG. 3 from above.

With regard to FIGS. 1 and 2, a tank is shown which is designated in tis entirety by the reference 1 and is filled with a bath of liquid metal 2, in particular zinc or zinc-aluminum.

This tank 1 comprises optionally a means 3 for regulating the temperature, for example induction heaters, immersion heaters or electrical resistance heaters in the case of a steel tank.

The tank 1 comprises two compartment separated by a partition 4, for example made of refractory bricks, which define a first chamber la forming a coating zone 5*a* and a second chamber 6 forming a zone 5*b* for cleaning the liquid metal bath.

A steel strip 7 circulates continuously, via a roller 8, in the coating zone 5*a*. At its inlet into the bath 2 of the coating zone 5*a*, the steel strip 7 is protected by a sheath 9.

During the immersion of the steel strip 7 in the liquid metal bath 2, the iron of the said strip is attacked by the liquid metal bath and dissolves into the said bath. Above the solubility limit, the iron reacts with the elements of the bath 2 to form solid intermetallic compounds in the form of zinc-iron, or zinc-iron-aluminum or zinc-aluminum particles in the case of hot dip galvanizing. Depending on their density and their composition, these particles rise to the surface or remain in saturated solution or settle on the bottom of the bath 2.

Consequently, the particles can be entrained by the strip 7 and remain included in the coating.

In order to prevent this, the tank 1 comprises means for continuous cycling of the liquid metal bath 2 between the coating zone 5*a* and the cleaning zone 5*b*.

These means consist of a first variable speed pump 10 which withdraws the polluted liquid metal bath 2 from the coating zone 5*a* in the proximity of the strip 7 and of the roller 8 via piping 11 and transmits it via piping 12 to the two ends of the cleaning zone 5*b* at a level which is between half and two thirds the height of the bath in the said cleaning zone 5*b*.

The means for continuous cycling of the liquid metal bath also comprise a second variable speed pump 13 which takes up the cleaned liquid metal bath 2 from the lower part of the cleaning zone 5*b* via piping 14 and transmits it back into the coating zone 5*a* via piping 15 in the proximity of the strip 7 and the roller 8.

The cleaning of the bath 2 in the zone 5*b* is based on the rise of the solid intermetallic compounds by lowering the solubility of iron in the cleaning zone 5*b*, when the temperature of the said bath 2 falls and/or when the aluminum content increases.

To this end, and taking account of the heat exchanges between the coating zone 5*a* and the cleaning zone 5*b*, the cleaning zone 5*b* is provided with a cooling fluid cycle 20, for example by circulation of a gas, such as air, or a liquid, such as water, so as to keep the temperature of the bath 2 in the zone 5*b* at a level which is lower than the temperature of the bath in the zone 5*a*.

The temperature of the bath in the zone 5*b* is between 435° and 460° C. and preferably between 440° and 450° C., while the temperature of the bath 2 in the coating zone 5*a* is between 440° and 490° C. and preferably between 460° and 470° C.

The proportion of aluminum is between 0.15 and 0.20% in the coating zone 5*a* and between 0.15 and 0.70%, preferably between 0.20 and 0.30%, in the cleaning zone 5*b*.

The enrichment with aluminum is effected using ingots previously enriched with aluminum or zinc ingots plus zinc-aluminum alloy ingots introduced at A and B (FIG. 2) into the cleaning zone 5*b*.

The ingots previously enriched with aluminum have an aluminum content of between 0.30 and 0.80% and preferably between 0.40 and 0.50%. In the case of a feed of pure zinc or of zinc having a low aluminum content, the enrichment is effected by addition of aluminum or zinc-aluminum alloy. This higher aluminum concentration accelerates the formation of iron-zinc-aluminum and iron-aluminum solid intermetallic compounds which are lighter than zinc.

In this zone 5*b* there is no effect of depletion of the bath 2 in aluminum, caused by the strip 7, as in the coating zone 5*a*.

As this rise of the solid intermetallic compounds takes a relatively long time and must be as complete as possible before return of the bath to the coating zone 5*a*, this rise is accelerated by local stirring of the bath 2.

To this end, the zone 5*b* is provided with a small pipe 21 for the introduction of a neutral gas, such as, for example, nitrogen, which emerges into the lower part of the said zone 5*b* and which creates microbubbling in this zone, forming an upward movement of the liquid and of the solid intermetallic compounds.

The intermetallic compounds which are said to have a matt surface are removed by an operator or by an automatic device.

In order to restrict the formation of zinc oxides at the surface of the cleaning zone 5*b*, this zone is provided with a cover 22 and an inlet 23 for neutral gas, such as, for example, nitrogen, so as to keep the upper part of the said zone 5*b* under a neutral atmosphere.

In the case of an existing tank 1, as shown in FIGS. 3 and 4, the cleaning zone 5*b* is formed by a tank 30 which is independent of the tank 1 and optionally provided with heating means 31.

As for the first embodiment, the apparatus comprises means (10, 11, 12, 13, 14 and 15) for continuous cycling of the liquid metal bath 2 between the coating zone 5*a* and the cleaning zone 5*b* and vice versa. The apparatus also comprises means for effecting the rise of the solid intermetallic compounds to the surface, said means consisting of the cooling cycle 20 of the bath 2 in order to lower the solubility limits of iron and/or the introduction of ingots previously enriched with aluminum or of zinc ingots plus zinc-aluminum alloy ingots at A and B in the said cleaning zone 5*b*.

The tank 30 is provided with means 21 for accelerating the rise of the solid intermetallic compounds and with a cover 22, as well as an injection 23 of neutral gas restricting the surface oxidation of the bath 2.

In the two embodiments, the apparatus comprises a system, which is not shown, for regulating the level of the liquid metal bath 2 and the variable speed pumps 10 and 13 may be replaced by any other equipment producing the same effect. The cycle flow rate of the bath 2 may vary between 6 and 60 T/h for example for a replenishment of the bath about every three hours. The bath 2 returning to the coating zone 5*a* is reheated and the rise in the temperature has the effect of raising the solubility of iron.

Following this treatment, the bath 2 has a reduced iron content, which can be below the saturation limit, and it has a minimum of supported solid intermetallic compounds.

The method according to the present invention enables the size and the amount of particles present in the bath to be restricted, particularly in the proximity of the strip, and consequently enables their presence in the coating to be restricted, which enables the surface appearance of the sheet metal to be improved, in particular for the visible parts of automobile bodywork.

We claim:

1. The method for cleaning a liquid metal bath intended for the continuous production of a steel strip coated by immersion in the bath, comprising:
   - continuously cycling the metal coating bath from a coating zone to a cleaning zone and back to the coating zone;
   - causing the solid intermetallic compounds contained in the bath to rise to the surface of the bath in the cleaning zone;
   - accelerating the rise to the surface in the cleaning zone of the solid intermetallic compounds; and
   - removing the risen compounds from the surface of the bath in the cleaning zone.

2. Method according to claim 1, wherein that the temperature of the bath in the cleaning zone is between 435° and 460° C. and preferably between 440° and 450° C., the temperature of the bath in the coating zone being between 440° and 490° C. and preferably between 460° and 470° C.

3. Method according to claim 1, wherein the rise of the solid intermetallic compounds is accelerated increasing the aluminum concentration of the bath in cleaning zone.

4. Method according to claim 3, wherein the aluminum concentration of the bath in the cleaning zone is between 0.15 and 0.70% and preferably between 0.20 and 0.30%.

5. An apparatus for cleaning a liquid metal bath intended for the continuous production of a steel strip coated by immersion in the bath, comprising:

means containing the bath defining a coating zone and a cleaning zone;

means for continuously cycling the liquid metal bath between said coating zone and said cleaning zone and vice versa;

means for effecting the rise to the surface of the bath, in said cleaning zone, of the solid intermetallic compounds contained in the bath; and means for accelerating the rise of the said solid intermetallic compounds, said cycling means including at least one variable speed pump and in that the said variable speed pump which withdraws the polluted liquid metal bath from said coating zone via piping and transmits it to said cleaning zone at a level which is between half and two thirds the height of the bath in said cleaning zone.

6. Apparatus according to claim 5, wherein the variable speed pump takes up the cleaned liquid metal bath from the lower part of the cleaning zone and transmits it through piping into the coating zone.

7. Apparatus according to claim 5 wherein the rise effecting means includes means for cooling the bath in said cleaning zone to maintain the temperature of the bath in said cleaning zone below the temperature of the bath in the coating zone.

8. Apparatus according to claim 5, wherein the rise accelerating means includes ingots which are introduced into the cleaning zone and the average aluminum content of which is between 0.30 and 0.80% and preferably between 0.40 and 0.50%.

9. The method defined in claim 1 wherein the rise to the surface is accelerated by lowering the temperature of the bath in the cleaning zone to below that in the coating zone in order to lower the solubility limit of iron in the cleaning zone so that the iron content of the cleaning bath is about the solubility limit.

10. The method defined in claim 1 wherein the rise to the surface is accelerated by local stirring of the bath in the cleaning zone by introducing a neutral gas into the lower part of the bath in the cleaning zone.

* * * * *